US011073152B2

(12) United States Patent
Kim et al.

(10) Patent No.: US 11,073,152 B2
(45) Date of Patent: Jul. 27, 2021

(54) COMPRESSOR CAPABLE OF PREVENTING A REDUCER FROM BEING DAMAGED

(71) Applicant: Hanon Systems, Daejeon (KR)

(72) Inventors: Hong Min Kim, Daejeon (KR); Kweon Soo Lim, Daejeon (KR); Soo Cheol Jeong, Daejeon (KR); Hun Teck Jo, Daejeon (KR)

(73) Assignee: Hanon Systems, Daejeon (KR)

( * ) Notice: Subject to any disclaimer, the term of this patent is extended or adjusted under 35 U.S.C. 154(b) by 235 days.

(21) Appl. No.: 16/356,093

(22) Filed: Mar. 18, 2019

(65) Prior Publication Data

US 2019/0293072 A1 Sep. 26, 2019

(30) Foreign Application Priority Data

Mar. 21, 2018 (KR) ..... 10-2018-0032421

(51) Int. Cl.
*F04C 29/02* (2006.01)
*F04C 18/02* (2006.01)
(Continued)

(52) U.S. Cl.
CPC ..... *F04C 29/026* (2013.01); *F04C 18/0215* (2013.01); *F04C 29/028* (2013.01); *F04C 2210/26* (2013.01); *F04C 2240/30* (2013.01)

(58) Field of Classification Search
CPC .. F04C 29/026; F04C 18/0215; F04C 29/028; F04B 39/16; F04B 39/04; F04B 39/0207; F04B 27/0821
See application file for complete search history.

(56) References Cited

U.S. PATENT DOCUMENTS

2005/0129536 A1* 6/2005 Ohtake ..... F04C 18/088 417/313
2009/0142202 A1* 6/2009 Inoue ..... F04B 27/1081 417/313

(Continued)

FOREIGN PATENT DOCUMENTS

JP 2001353431 A 12/2001
JP 2014009831 A 1/2014

(Continued)

*Primary Examiner* — Deming Wan
(74) *Attorney, Agent, or Firm* — Norton Rose Fulbright US LLP; James R. Crawford

(57) ABSTRACT

Disclosed herein may be a compressor. The compressor may include: a casing; a compression unit configured to suck refrigerant from a suction space of the casing, compress the sucked refrigerant, and discharge the compressed refrigerant to a discharge space of the casing; an oil recovery passage configured to recover oil separated from refrigerant in the discharge space to the suction space; and a reducer inserted into the oil recovery passage to reduce a pressure of oil passing through the oil recovery passage. The reducer may include a deformation preventing unit configured to prevent the reducer from being damaged when the reducer is inserted into the oil recovery passage. Therefore, the reducer may be prevented from being damaged when the reducer is inserted into the oil recovery passage. The costs required to prevent the reducer from being damaged, check the conditions of the reducer, and repair reducer may be reduced.

10 Claims, 7 Drawing Sheets

(51) Int. Cl.

| | |
|---|---|
| ***F04B 39/16*** | (2006.01) |
| ***F04B 39/04*** | (2006.01) |
| ***F04B 39/02*** | (2006.01) |

(56) References Cited

U.S. PATENT DOCUMENTS

| | | | | |
|---|---|---|---|---|
| 2013/0028730 | A1* | 1/2013 | Hirata | F04B 39/121<br>415/229 |
| 2016/0136555 | A1* | 5/2016 | Yoshioka | F04B 39/023<br>62/470 |
| 2018/0195505 | A1* | 7/2018 | Ham | F04C 29/028 |

FOREIGN PATENT DOCUMENTS

| | | | |
|---|---|---|---|
| JP | 2017527738 | A | 9/2017 |
| KR | 20150099901 | A | 9/2015 |
| WO | 2017/164539 | A1 | 9/2017 |

* cited by examiner

COMPRESSOR CAPABLE OF PREVENTING A REDUCER FROM BEING DAMAGED

CROSS-REFERENCE TO RELATED APPLICATION

This application claims priority from Korean Patent Application No. 10-2018-0032421 filed on Mar. 21, 2018, which is hereby incorporated herein by reference in its entirety.

BACKGROUND OF THE DISCLOSURE

Field of the Disclosure

Exemplary embodiments of the present disclosure relate to a compressor, and more particularly, to a compressor configured such that oil separated from compressed refrigerant may be reduced in pressure and recovered to refrigerant to be compressed.

Description of the Related Art

Generally, air conditioning (NC) apparatuses for cooling or heating passenger compartments are installed in vehicles. Such an air conditioning apparatus includes, as a configuration for a cooling system, a compressor, which compresses low-temperature and low-pressure gaseous refrigerant drawn from an evaporator into a high-temperature and high-pressure gaseous state, and transmits it to a condenser.

Typically, a compressor for vehicles is formed of a mechanical compressor which is driven using driving force transmitted from an engine. On the other hand, for example, a compressor for electric vehicles may be formed of an electric compressor which is driven using driving force transmitted from a motor.

Such compressors are classified into a reciprocating compressor which compresses refrigerant using reciprocating motion of a piston, and a rotary compressor which performs rotational motion to compress refrigerant. According to a driving force transmission method, reciprocating compressors are classified into a crank type in which driving force is transmitted by a plurality of pistons using a crank, a swash plate type in which driving force is transmitted by a rotating shaft provided with a swash plate, and so forth. Rotary compressors are classified into a vane rotary type which employs a rotary shaft and a vane, and a scroll type which employs a turning scroll and a fixed scroll.

Scroll compressors, which smoothly perform intake, compression, and discharge strokes on refrigerant to reliably obtain a satisfactory torque, while obtaining a high compression ratio, compared to other types of compressors, have been widely used for compressing refrigerant in air-conditioning apparatuses, or the like.

Compressors may include an oil recovery passage and a reducer which are configured to reduce the pressure of oil separated from compressed refrigerant and recover the oil to refrigerant to be compressed.

In detail, referring to FIGS. 1 to 3 in Korean Patent Unexamined Publication No. 10-2015-0099901, the conventional compressor includes: a casing; a compression unit which sucks refrigerant from a suction space of the casing, compresses the sucked refrigerant, discharges the compressed refrigerant to a discharge space of the casing; and an oil recovery passage 2 which recovers oil separated from the refrigerant in the discharge space to the suction space.

The compression unit includes a fixed scroll which is fixed in the casing, and a turning scroll which forms a compression chamber along with the fixed scroll.

The oil recovery passage 2 is formed by communicating a plurality of separated passage holes with each other. In other words, the oil recovery passage 2 includes a first passage hole which passes through the fixed scroll and communicates with the discharge space, and a second passage hole which passes through the casing and communicates the suction space with the first passage hole.

On the one hand, because the pressure in the discharge space is a discharge pressure (high pressure) and the pressure in the suction space is a suction pressure (low pressure), oil is required to be reduced in pressure when passing through the oil recovery passage 2.

Given this, a reducer is provided in the oil recovery passage 2 to reduce the pressure of oil passing through the oil recovery passage 2.

The reducer is formed of a so-called nozzle-type orifice in which a pressure to be reduced is changed depending on a difference in pressure between an upstream side and a downstream side of the reducer. In detail, the reducer includes a shaft part which extends from an upstream side of the oil recovery passage to a downstream side thereof, and a spiral part which is formed on an outer circumferential surface of the shaft part.

Here, the spiral part is forcibly fitted into the oil recovery passage, and an oil transfer groove is formed by the outer circumferential surface of the shaft part, a side surface of the spiral part, and an inner circumferential surface of the oil recovery passage.

In the conventional compressor having the above-mentioned configuration, the turning scroll rotates using driving force transmitted thereto and sucks, along with the fixed scroll, refrigerant from the suction space, compresses the refrigerant, and then discharges it to the discharge space.

Refrigerant discharged to the discharge space is separated from oil contained in the refrigerant by an oil separator, and then discharged out of the compressor via a discharge pipe.

Oil separated form the refrigerant in the discharge space is recovered to the suction space through the oil recovery passage 2, and reduced in pressure by the reducer during the recovery process. In detail, oil that passes through the oil recovery passage 2 is spirally transferred along the oil transfer groove of the reducer, so that the pressure of oil reduces due to an increase in the distance that the oil moves.

Oil recovered to the suction space is supplied, along with refrigerant to be compressed, to corresponding drive parts.

However, in the conventional compressor, when the reducer is inserted into the oil recovery passage, the spiral part of the reducer may be damaged. In this case, oil may not be reduced in pressure, or the oil recover passage may be clogged.

Furthermore, there is a problem in that costs required to prevent the spiral part from being damaged, check the conditions of the spiral part, and repair the spiral part may be increased.

In other words, to prevent the spiral part from being damaged, a considerable expense is needed to manage the dimensions of the oil recovery passage within a predetermined range.

Furthermore, with regard to the management of the dimensions of the oil recovery passage, the production cost of a component (e.g., the fixed scroll) in which the oil recovery passage is formed may be increased. In detail, a plating layer is formed on the surface of the fixed scroll so as to enhance abrasion resistance and lubrication, taking into account friction between the fixed scroll and the turning scroll. Here, in the case where the plating layer is formed on the oil recovery passage (first passage hole) formed in the fixed scroll, it is difficult to manage the dimensions of the oil recovery passage. Due to this, the fixed scroll having the oil recovery passage is manufactured through a complex manufacturing process (in which an operation of processing the fixed scroll, an operation of masking the oil recovery passage, a plating operation, an operation of removing the mask from the oil recovery passage, and an operation of forcibly fitting the reducer are performed in succession) for preventing the plating layer from being formed on the oil recovery passage of the fixed scroll. Therefore, the production cost of the fixed scroll is increased.

In addition, an expense is required for checking whether the reducer inserted into the oil recovery passage has been damaged (defective).

Furthermore, if a damage to the reducer is detected, an expense is required to replace the damaged reducer with a new one.

SUMMARY OF THE DISCLOSURE

An object of the present disclosure is to provide a compressor capable of preventing a reducer from being damaged when the reducer is inserted into an oil recovery passage.

Another object of the present disclosure is to provide a compressor capable of reducing the costs required to prevent the reducer from being damaged, check the conditions of the reducer, and repair the reducer.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, a compressor including: a casing; a compression unit configured to suck refrigerant from a suction space of the casing, compress the sucked refrigerant, and discharge the compressed refrigerant to a discharge space of the casing; an oil recovery passage configured to recover oil separated from refrigerant in the discharge space to the suction space; and a reducer inserted into the oil recovery passage to reduce a pressure of oil passing through the oil recovery passage, wherein the reducer may include a deformation preventing unit configured to prevent the reducer from being damaged when the reducer is inserted into the oil recovery passage.

The reducer may include: a shaft part extending from an upstream side of the oil recovery passage to a downstream side thereof; a spiral part formed on an outer circumferential surface of a medial portion of the shaft part; and a rib part provided on an outer circumferential surface of at least one of a first end and a second end of the shaft part, wherein the deformation preventing unit may be formed of the rib part.

The rib part may include: a first rib part provided on an outer circumferential surface of the first end of the shaft part; and a second rib part provided on an outer circumferential surface of the second end of the shaft part.

The rib part may include a plurality of rib parts, and the plurality of rib parts may be disposed at regular intervals along a circumferential direction of the shaft part.

One of the plurality of rib parts may be formed to overlap a leading end of the spiral part in an axial direction of the shaft part.

Each of the rib parts may extend along an axial direction of the shaft part.

An outer diameter of the rib part may be greater than or equal to an inner diameter of the oil recovery passage.

The outer diameter of the spiral part may be greater than or equal to the outer diameter of the rib part.

The compression unit may include: a fixed scroll stationarily installed in the casing; and a turning scroll provided to form a compression chamber along with the fixed scroll. A first passage hole that is a part of the oil recovery passage may be formed in the fixed scroll. A plating layer may be formed on an inner circumferential surface of the first passage hole. The reducer may be inserted into the first passage hole provided with the plating layer.

The shaft part, the spiral part, and the rib part may be integrally formed with each other.

The shaft part and the spiral part may be integrally formed with each other. The rib part may be removably provided on the shaft part and the spiral part.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Hereinafter, a compressor in accordance with the present disclosure will be described in detail with reference to the accompanying drawings.

Figure 1:
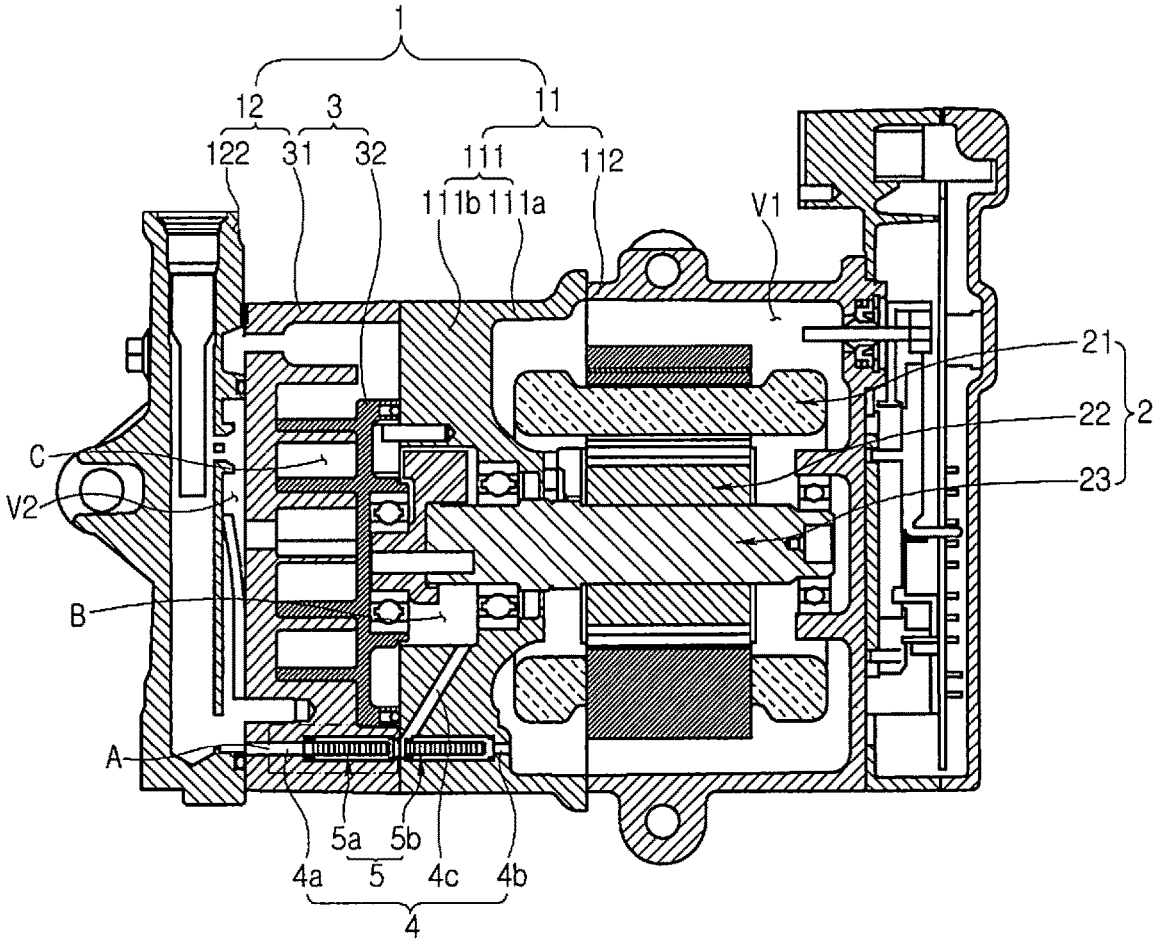
FIG. 1 is a sectional view illustrating a compressor in accordance with an embodiment of the present disclosure.
Figure 2:
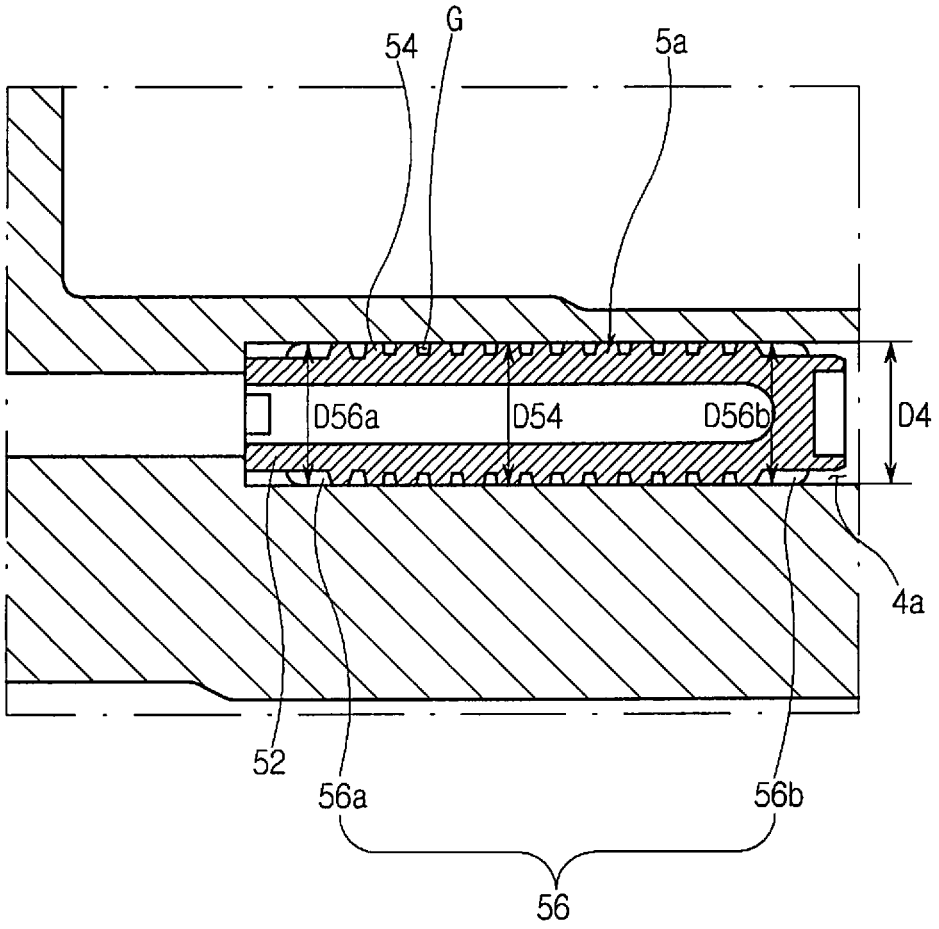
FIG. 2 is an enlarged view of portion A of FIG. 1.
Figure 3:
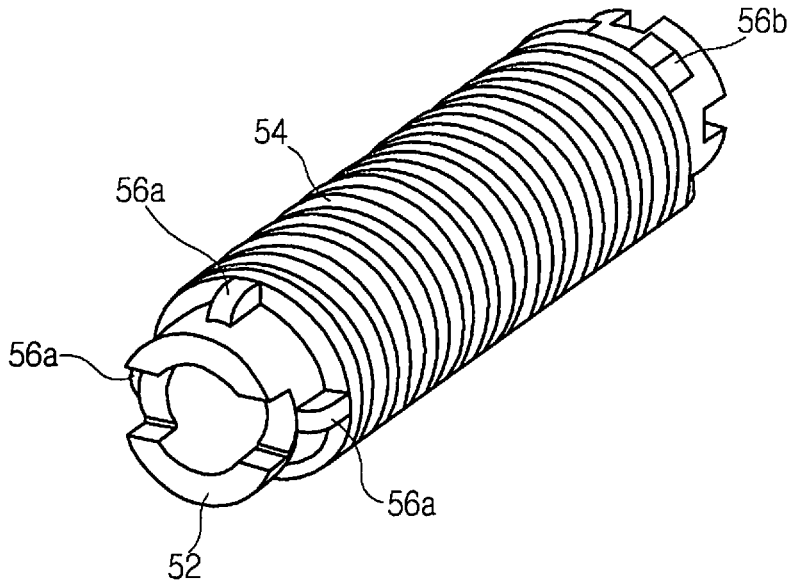
FIG. 3 is a front perspective view illustrating a reducer of FIG. 2.
Figure 4:
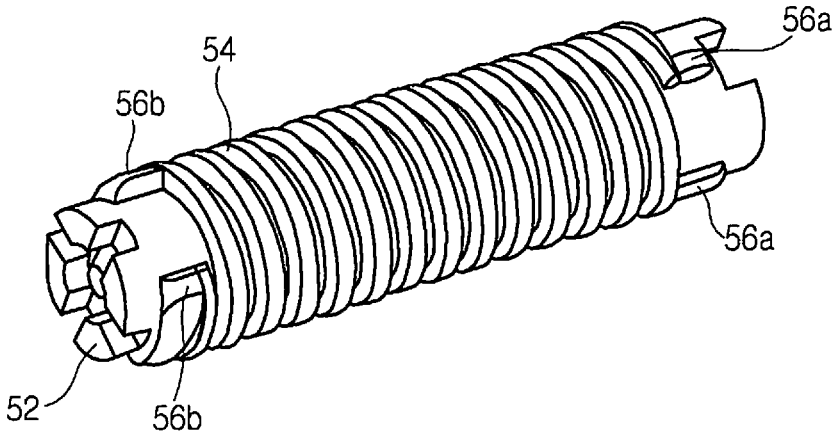
FIG. 4 is a rear perspective view of the reducer of FIG. 2.

FIG. 1 is a sectional view illustrating a compressor in accordance with an embodiment of the present disclosure. FIG. 2 is an enlarged view of portion A of FIG. 1. FIG. 3 is a front perspective view illustrating a reducer of FIG. 2. FIG. 4 is a rear perspective view of the reducer of FIG. 2.

Referring to FIGS. 1 to 4, the compressor in accordance with the embodiment of the present disclosure includes a casing 1, a drive unit 2, a compression unit 2, an oil recovery passage 4, and a reducer 5. The drive unit 2 may generate driving force. The compression unit 3 may receive driving force from the drive unit 2, suck refrigerant from a suction space V1 of the casing 1, compress the sucked refrigerant, and discharge the compressed refrigerant to a discharge space V2 of the casing 1. The oil recovery passage 4 may recover oil separated from refrigerant in the discharge space V2 to the suction space V1. The reducer 5 is inserted into the oil recovery passage 4 and configured to reduce the pressure of oil passing through the oil recovery passage 4.

The casing 1 may include a first housing 11 having the suction space V1, and a second housing 12 which is coupled to the first housing 11 and has the discharge space V2.

The first housing 11 may include a center housing 111 in which a main frame 111*b* is formed, and a front housing 112 which is coupled to the center housing 111 and forms the suction space V1.

The center housing 111 may include an outer center-housing sidewall 111*a* having an annular shape, and the main frame 111*b* covering one end of the outer center-housing sidewall 111*a*.

The other end of the outer center-housing sidewall 111*a* may be covered with the front housing 112. Thereby, the suction space V1 may be formed by the outer center-housing sidewall 111*a*, the main frame 111*b*, and the front housing 112.

The outer center-housing sidewall 111*a* may communicate with a refrigerant intake pipe (not show) configured to guide refrigerant from the outside of the compressor into the suction space V1.

The main frame 111*b* may have a suction hole (not shown) formed to guide refrigerant from the suction space V1 to the compression unit 3.

The main frame 111*b* may have a back pressure chamber B formed to pressurize a turning scroll 32, which will be described later, to a fixed scroll 31, which will be also described later.

The second housing 12 may include the fixed scroll 31 and a rear housing 122. The fixed scroll 31 may be disposed on a side opposite to the front housing 112 based on the center housing 111, and may be coupled to the center housing 111. The rear housing 122 may be disposed on a side opposite to the center housing 111 based on the fixed scroll 31, and may be coupled to the fixed scroll 31 to form the discharge space V2.

Here, in the present embodiment, there is illustrated the case where the fixed scroll 31 forms not only the compression unit 3 but also the second housing 12. However, the present disclosure is not limited to this. For example, the rear housing 122 may be coupled to the center housing 111 to form the second housing 12, and the fixed scroll 31 may be housed in the second housing 12 to form the compression unit 3.

The second housing 12 (in more detail, the rear housing 122) may communicate with a refrigerant discharge pipe (not shown) configured to guide refrigerant from the discharge space V2 to the outside of the compressor.

The discharge space V2 of the second housing 12 may communicate with the oil recovery passage 4.

The drive unit 2 may be formed of a stator 21, a rotor 22 disposed inside the stator 21 and configured to rotate by interaction with the stator 21, and a motor having a rotating shaft 23 coupled to the rotor 22.

The stator 21 and the rotor 22 may be housed in the suction space V1. The rotating shaft 23 may pass through the main frame 111*b* and extend from the suction space V1 toward the discharge space V2.

The compression unit 3 may include the fixed scroll 31, and the turning scroll 32 which forms a pair of compression chambers C along with the fixed scroll 31.

The turning scroll 32 may be interposed between the main frame 111*b* and the fixed scroll 31, and supported by the main frame 111*b*. The turning scroll 32 may be configured to be rotatable using rotating force transmitted from the drive unit 2 through the rotating shaft 23.

The oil recovery passage 4 may be formed by communicating a plurality of separated passage holes with each other. In other words, the oil recovery passage 4 may include a first passage hole 4*a* which is formed in the fixed scroll 31 and communicates with the discharge space V2, and a second passage hole 4*b* which is formed in the center housing 111 and communicates the first passage hole 4*a* with the suction space V1.

The oil recovery passage 4 may further include a third passage hole 4*c* which communicates an inlet end of the second passage hole 4*b* with the back pressure chamber B.

The reducer 5 may include a first reducing member 5*a* and a second reducing member 5*b*. The first reducing member 5*a* may be disposed in the first passage hole 4*a* so as to reduce the pressure of oil drawn from the discharge space V2 from a discharge pressure into an intermediate pressure. The second reducing member 5*b* may be disposed in the second passage hole 4*b* so as to reduce the pressure of oil drawn from the first passage hole 4*a* from the intermediate pressure into a suction pressure.

The reducer 5 may be formed of a so-called nozzle-type orifice in which a pressure to be reduced is changed depending on a difference in pressure between an upstream side and a downstream side of the reducer.

In detail, the reducer 5 may include a shaft part 52 which extends from an upstream side of the oil recovery passage 4 to a downstream side thereof, and a treaded part 54 which is formed on an outer circumferential surface of a medial portion of the shaft part 52.

The shaft part 52 may have the form of a cylinder, an outer diameter of which is less than an inner diameter D4 of the oil recovery passage 4.

The spiral part 54 may be formed of a tread protruding from the outer circumferential surface of the shaft part 52.

The spiral part 54 may be formed such that the outer diameter D54 of the spiral part 54 (that is two times a distance between a center axis of the shaft part 52 and a spiral line of the spiral part 54) is greater than or equal to the inner diameter D4 of the oil recovery passage 4 so that the reducer 5 can be forcibly fitted into the oil recovery passage 4. Here, the spiral part 54 is formed such that the outer diameter D54 of the spiral part 54 is greater than or equal to the inner diameter D4 of the oil recovery passage 4 before the reducer 5 is inserted into the oil recovery passage 54. However, as the reducer 5 is inserted into the oil recovery passage 4, the outer diameter D54 of the spiral part 54 is changed to a value equal to the inner diameter D4 of the oil recovery passage 4 so that the reducer 5 can be forcibly fitted to the inner circumferential surface of the oil recovery passage 4.

The shaft part 52 and the spiral part 54 that have the above-mentioned configurations may form, along with the oil recovery passage 4, an oil transfer groove G which increases the distance that oil moves in the oil recovery passage 4 to reduce the pressure of oil. In other words, the outer circumferential surface of the shaft part 52, the side surface of the spiral part 54, and the inner circumferential surface of the oil recovery passage 4 may form the oil transfer groove G. As the oil transfer groove G spirally moves oil, the distance that the oil moves may be increased.

On the one hand, when the reducer 5 is inserted into the oil recovery passage 4, the spiral part 54 may be damaged.

In detail, if the reducer 5 is inserted into the oil recovery passage 4 while the axis of the shaft part 52 is inclined relative to the axial direction of the oil recovery passage 4, a leading end of the spiral part 54 may be crushed by the oil recovery passage 4.

Furthermore, a trailing end of the spiral part 54 that is clamped to perform the operation of inserting the reducer 5 into the oil recovery passage 4 may be crushed by force applied to the trailing end of the spiral part 54.

Given this, the reducer 5 in accordance with the present embodiment may further include a rib part 56 provided to prevent the spiral part 54 from being damaged when the reducer 5 is inserted into the oil recovery passage 4.

The rib part 56 may include a first rib part 56*a* formed on an outer circumferential surface of a first end of the shaft part 52, and a second rib part 56*b* formed on an outer circumferential surface of the shaft part 52.

Here, the first end of the shaft part 52 is a portion of the reducer 5 that is first inserted into the oil recovery passage 4 during the process of inserting the reducer 5 into the oil recovery passage 4, and the second end of the shaft part 52 is a portion of the reducer 5 that is lastly inserted into the oil recovery passage 4 during the process of inserting the reducer 5 into the oil recovery passage 4.

The first rib part 56*a* may comprise a plurality of first rib parts 56*a* for guiding the position of the reducer 5 such that the axial direction of the shaft part 52 is parallel to the axial direction of the oil recovery passage 4 when the reducer 5 is inserted into the oil recovery passage 4. The plurality of first rib parts 56*a* may be disposed at regular intervals along a circumferential direction of the shaft part 52. Each first rib part 56*a* may extend along the axial direction of the shaft part 52.

The plurality of first rib parts 56*a* are formed such that the distances between the center axis of the shaft part 52 and the respective outer circumferential surfaces of the first rib parts 56*a* are equivalent to each other so that the plurality of first rib parts 56*a* are forcibly fitted into the oil recovery passage 4 so as to more reliably guide the position of the reducer 5. Here, an outer diameter D56*a* of the plurality of first rib parts 56*a* (that is two times the distance between the center axis of the shaft part 52 and the outer circumferential surface of each first rib part 56*a*) may be greater than or equal to the inner diameter D4 of the oil recovery passage 4. Here, the plurality of first rib parts 56*a* are formed such that the outer diameter D56*a* of the first rib parts 56*a* is greater than or equal to the inner diameter D4 of the oil recovery passage 4 before the reducer 5 is inserted into the oil recovery passage 1. However, as the reducer 5 is inserted into the oil recovery passage 4, the outer diameter D56*a* of the first rib parts 56*a* is changed to a value equal to the inner diameter D4 of the oil recovery passage 4 so that the reducer 5 can be forcibly fitted to the inner circumferential surface of the oil recovery passage 4.

The plurality of first rib parts 56*a* are disposed at the upstream side of the spiral part 54 and block an inlet side of the oil transfer groove G to reduce the flow cross-section area of the inlet side of the oil transfer groove G. To minimize the reduction in the flow cross-sectional area of the inlet side of the oil transfer groove G due to the location of the plurality of first rib parts 56*a*, one of the plurality of first rib parts 56*a* may be formed to overlap the leading end of the spiral part 54 in the axial direction of the shaft part 52.

Furthermore, when the plurality of first rib parts 56*a* are forcibly fitted into the oil recovery passage 4, each first rib part 56*a* expands in the circumferential direction and thus reduce the flow cross-sectional area of the inlet side of the oil transfer groove G. To minimize the reduction in the flow cross-sectional area of the inlet side of the oil transfer groove G due to the deformation of the plurality of first rib parts 56*a*, the outer diameter 56*a* of the plurality of first rib parts 56*a* may be less than or equal to the outer diameter D54 of the spiral part 54.

The second rib part 56*b* may have the same shape as that of the first rib part 56*a*, taking into account the case where the reducer 5 is inserted into the oil recovery passage 4 in the reverse direction, e.g., due to a mistake of a worker.

In other words, the second rib part 56*b* may comprise a plurality of second rib parts 56*b*. The plurality of second rib parts 56*b* may be disposed at regular intervals along the circumferential direction of the shaft part 52. Each second rib part 56*b* may extend along the axial direction of the shaft part 52.

The plurality of second rib parts 56*b* are formed such that the distances between the center axis of the shaft part 52 and the respective outer circumferential surfaces of the second rib parts 56*b* are equivalent to each other. Here, an outer diameter D56*b* of the plurality of second rib parts 56*b* (that is two times the distance between the center axis of the shaft part 52 and the outer circumferential surface of each second rib part 56*b*) may be greater than or equal to the inner diameter D4 of the oil recovery passage 4. Here, the plurality of second rib parts 56*b* are formed such that the outer diameter D56*b* of the second rib parts 56*b* is greater than or equal to the inner diameter D4 of the oil recovery passage 4 before the reducer 5 is inserted into the oil recovery passage 2. However, as the reducer 5 is inserted into the oil recovery passage 4, the outer diameter D56*b* of the second rib parts 56*b* is changed to a value equal to the inner diameter D4 of the oil recovery passage 4 so that the reducer 5 can be forcibly fitted to the inner circumferential surface of the oil recovery passage 4.

In addition, one of the plurality of second rib parts 56*b* may be formed to overlap the trailing end of the spiral part 54 in the axial direction of the shaft part 52.

Furthermore, the outer diameter D56*b* of the plurality of second rib parts 56*b* may be less than or equal to the outer diameter D54 of the spiral part 54.

Hereinafter, the operation and effect of the compressor in accordance with the present embodiment will be described.

When power is applied to the drive unit 2, the rotating shaft 23 along with the rotor 22 may rotate to transmit rotating force to the turning scroll 32.

Then, the turning scroll 32 is rotated by the rotating shaft 23, whereby the volume of the compression chamber C is reduced toward the central portion of the compressor.

Thereby, refrigerant may be sucked into the compression chamber C through the refrigerant suction pipe (not shown), the suction space V1, and the suction hole (not shown).

The refrigerant that has been sucked into the compression chamber C may be transferred toward the central portion along a transfer path of the compression chamber C and thus compressed, before being discharged to the discharge space V2.

The refrigerant that has been discharged to the discharge space V2 may be discharged out of the compressor through the refrigerant discharge pipe (not shown) after oil that has been contained in the refrigerant is separated from the refrigerant by the oil separator.

The oil that has been separated from the refrigerant by the oil separator may be collected in a lower portion of the discharge space V2, and recovered to the suction space V1 through the oil recovery passage 4. The oil recovered to the suction space V1 may be supplied, along with refrigerant to be compressed, to the corresponding drive parts.

In more detail, the oil collected in the discharge space V2 may be drawn into the first passage hole 4*a*.

The oil that has been drawn into the first passage hole 4*a* may be reduced in pressure from the discharge pressure to an intermediate pressure lower than the discharge pressure while passing through the first reducing member 5*a*.

The oil that has passed through the first reducing member 5*a* may diverge so that some of the oil may be drawn into the second passage hole 4*b* and the other oil may be drawn into the third passage hole 4*c*.

The oil that has been drawn into the second passage hole 4*b* may be reduced in pressure from the intermediate pressure to the suction pressure lower than the intermediate pressure while passing through the second reducing member 5*b*.

The oil that has passed through the second reducing member 5*b* may be recovered into the suction space V1.

The oil that has been drawn into the third passage hole 4*c* may be supplied into the back pressure chamber B.

The oil that has been drawn into the back pressure chamber B may pressurize the turning scroll 32 toward the fixed scroll 31, lubricate a bearing that supports the rotating shaft 23, a junction between the main frame 111*b* and the turning scroll 32, and so forth, and then be drawn into the compression chamber C or the suction space V1.

In the compressor according to the present embodiment, since the reducer 5 includes the rib parts 56, the spiral part 54 may be prevented from being damaged when the reducer 5 is inserted into the oil recovery passage 4.

In detail, because the reducer 5 includes the first rib parts 56*a*, the reducer 5 may be inserted into the oil recovery passage 4 in a state in which the axis of the shaft part 52 is parallel to the axial direction of the oil recovery passage 4. Thereby, the leading end of the spiral part 54 may be prevented from being crushed and damaged by the oil recovery passage 4.

Furthermore, because the reducer 5 includes the second rib parts 56*b*, the second rib parts 56*b* in lieu of the trailing end of the spiral part 54 may be clamped. In other words, the second rib parts 56*b* may substitute for the part to be clamped to perform the operation of inserting the reducer 5 into the oil recovery passage 4. Thereby, the trailing end of the spiral part 54 may be prevented from being crushed and damaged by force applied to the trailing end of the spiral part 54 when the trailing end of the spiral part 54 is clamped.

The configuration using the rib part 56 capable of preventing damage to the spiral part 54 may not only solve the problem that oil may not be reduced in pressure or the oil recovery passage 4 may be clogged, but may also reduce the costs required to prevent the reducer 5 from being damaged, check the conditions of the reducer 5, and repair reducer 5.

In detail, even when the dimensions of the oil recovery passage 4 are loosely managed, the rib part 56 may prevent the spiral part 54 from being damaged. Hence, the costs needed to manage the dimensions of the oil recovery passage 4 may be reduced.

In connection with the management in the dimensions of the oil recovery passage 4, the production cost of a part in which the oil recovery passage 4 is formed may be reduced. For example, in the case of the fixed scroll 31 in which the first passage hole 4*a* of the oil recovery passage 4 is formed, the plating layer is formed on the surface of the fixed scroll 31 so as to enhance abrasion resistance and lubrication, taking into account friction between the fixed scroll 31 and the turning scroll 32. With regard to this, in the conventional art, to manage the dimensions of the first passage hole 4*a*, the fixed scroll 31 is manufactured through the complex manufacturing process (including the fixed scroll processing operation, the oil recovery passage masking operation, the plating operation, the operation of removing the mask from the oil recovery passage, and the reducer force-fitting operation) for preventing the plating layer from being formed on the first passage hole 4*a*. However, in the present embodiment, as described above, the dimensions of the oil recovery passage 4 may be loosely managed. Thereby, even when the plating layer is formed on the first passage hole 4*a*, the spiral part 54 may be prevented from being damaged. Thus, in the present embodiment, the fixed scroll 31 may be manufactured through a comparatively simple manufacturing process (including a fixed scroll processing operation, a plating operation, and a reducer force-fitting operation) from which the masking operation and the operation of removing the mask from the oil recovery passage 4 are omitted. In other words, after the plating layer has been formed on the first passage hole 4*a*, the reducer 5 may be inserted into the first passage hole 4*a* on which the plating layer has been formed. As such, as the manufacturing process is simplified, the production cost of the fixed scroll 31 may be reduced.

Furthermore, since it may be checked whether the reducer 5 that has been inserted into the oil recovery passage 4 has been damaged (defective), the costs required to check the conditions of the reducer 5 may be reduced.

In addition, there is no need to replace the damaged reducer 5 with a new reducer 5, the costs required for the replacement may be reduced.

Figure 5:
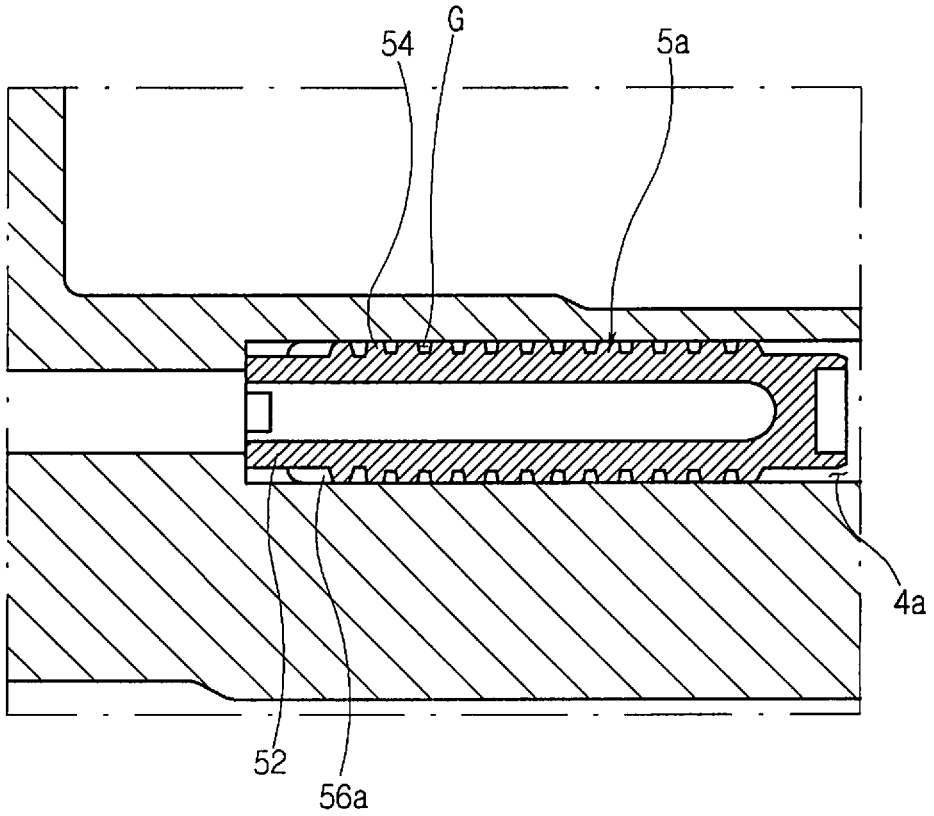
FIG. 5 is a sectional view illustrating a reducer of a compressor in accordance with another embodiment of the present disclosure.

On the one hand, in the present embodiment, the rib part 56 includes the first rib part 56*a* and the second rib part 56*b*. However, as shown in FIG. 5, the rib part 56 may include only any one of the first rib part 56*a* and the second rib part 56*b*. In this case, the costs required to form the reducer 5 may be reduced, and the leading end or the trailing end of the spiral part 54 may be prevented from being damaged. In other words, in the case where the rib part 56 includes the first rib part 56*a*, the costs needed to form the second rib part 56*b* is not required, and the leading end of the spiral part 54 may be prevented from being damaged. Alternatively, in the case where the rib part 56 includes the second rib part 56*b*, the costs needed to form the first rib part 56*a* is not required, and the trailing end of the spiral part 54 may be prevented from being damaged. However, because a cost reduction obtained by preventing, using the rib part 56, the spiral part 54 from being damaged is greater than a cost increase required to form the rib part 56, it may be preferable that the rib part 56 include both the first rib part 56*a* and the second rib part 56*b*.

Figure 6:
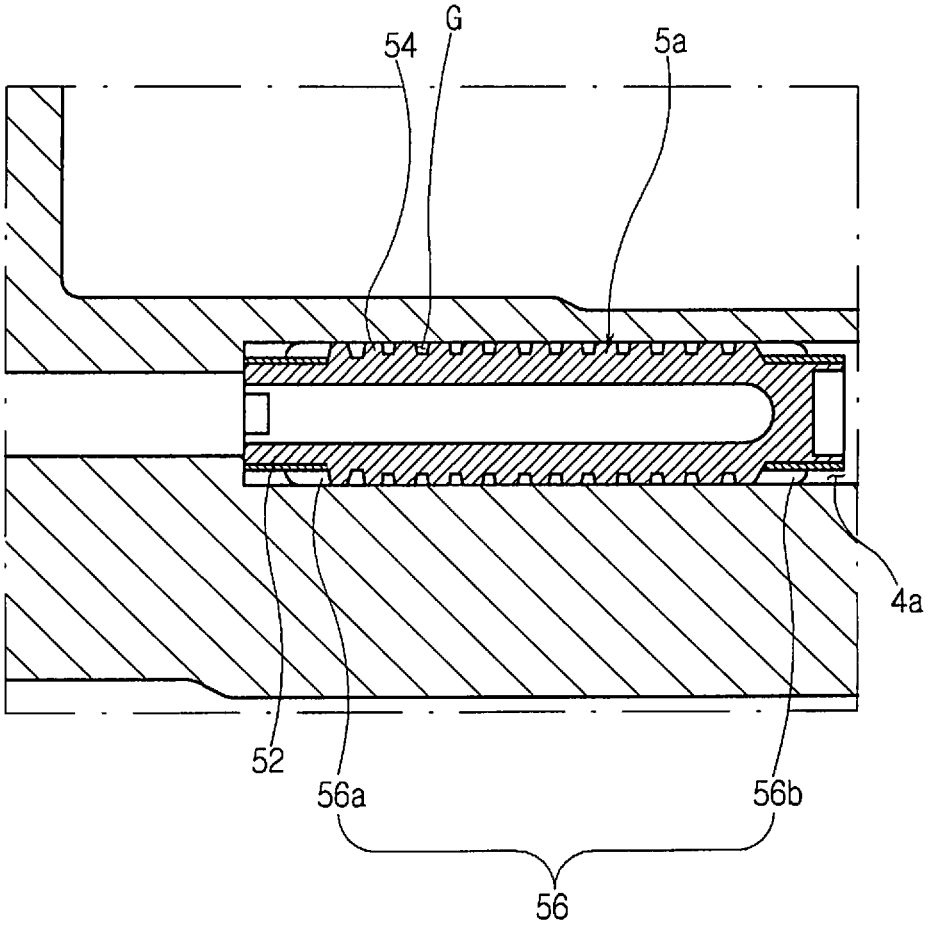
FIG. 6 is a sectional view illustrating a reducer of a compressor in accordance with yet another embodiment of the present disclosure.
Figure 7:
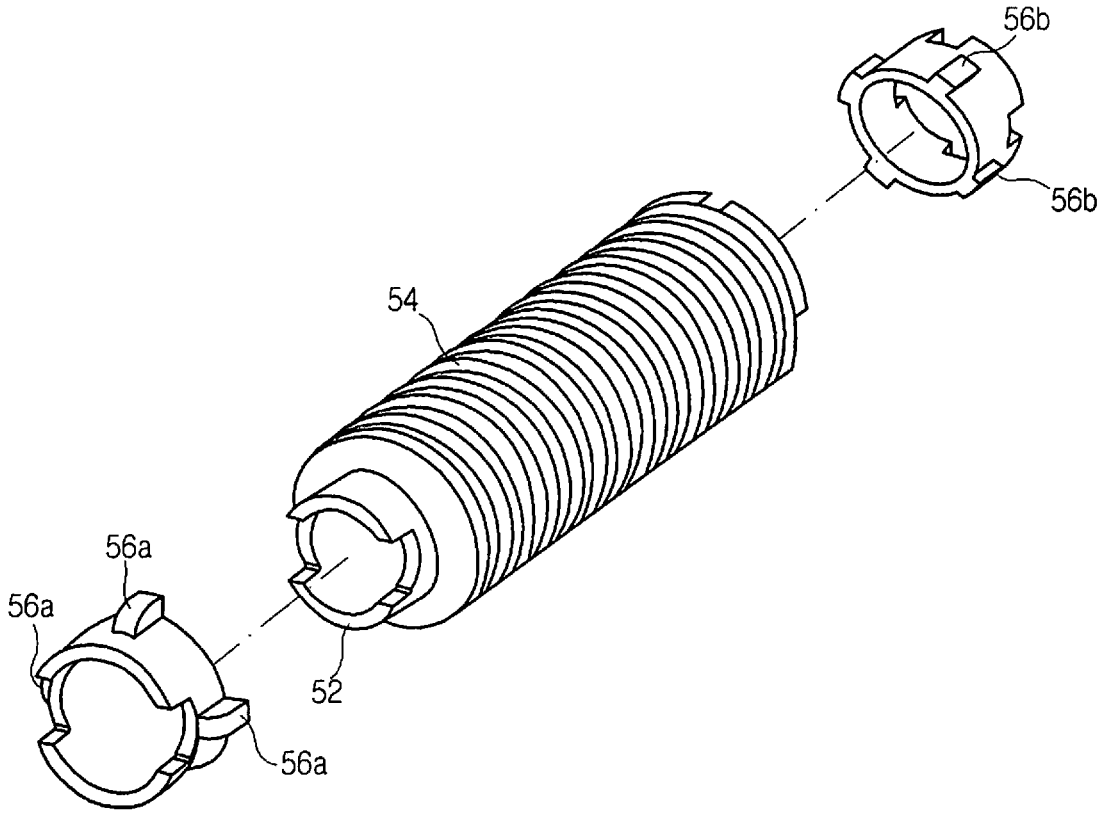
FIG. 7 is an exploded perspective view illustrating the reducer of FIG. 6.

On the one hand, in the present embodiment, the shaft part 52, the spiral part 54, and the rib part 56 are integrally formed with each other. However, as shown in FIGS. 6 and 7, the shaft part 52 and the spiral part 54 are integrally formed with each other, and the rib part 56 may be removably provided on the shaft part 52 and the spiral part 54. Here, the rib part 56 may be coupled to the shaft part 52 and the spiral part 54 before being inserted into the oil recovery passage 4. Alternatively, the rib part 56 may be inserted into the oil recovery passage 4 before being coupled to the shaft part 52 and the spiral part 54. In this case, the reducer 5 may include at least one of the first rib part 56*a* and the second rib part 56*b*, as needed. Furthermore, in this case, if some of the shaft part 52, the spiral part 54, and the rib part 56 are defective, only the defective parts may be replaced with new ones. Therefore, replacement costs may be reduced.

While the present disclosure has been described with respect to the specific embodiments, it will be apparent to those skilled in the art that various changes and modifications may be made without departing from the spirit and scope of the disclosure as defined in the following claims.

What is claimed is:

1. A compressor comprising:

a casing;

a compression unit configured to suck refrigerant from a suction space of the casing, compress the sucked refrigerant, and discharge the compressed refrigerant to a discharge space of the casing;

an oil recovery passage configured to recover oil separated from the refrigerant in the discharge space to the suction space; and a reducer inserted into the oil recovery passage to reduce a pressure of oil passing through the oil recovery passage, wherein the reducer comprises a deformation preventing unit configured to prevent the reducer from being damaged when the reducer is inserted into the oil recovery passages, wherein the reducer includes a shaft part extending from an upstream side of the oil recovery passage to a downstream side thereof, a spiral part formed on an outer circumferential surface of a medial portion of the shaft part, and a rib part provided on an outer circumferential surface of at least one of a first end and a second end of the shaft part, and wherein the deformation preventing unit is formed of the rib part.

2. The compressor according to claim 1, wherein the rib part comprises:

a first rib part provided on the outer circumferential surface of the first end of the shaft part; and a second rib part provided on the outer circumferential surface of the second end of the shaft part.

3. The compressor according to claim 1, wherein the rib part comprises a plurality of rib parts, and wherein the plurality of rib parts are disposed at regular intervals along a circumferential direction of the shaft part.

4. The compressor according to claim 3, wherein one of the plurality of rib parts is formed to overlap a leading end of the spiral part in an axial direction of the shaft part.

5. The compressor according to claim 3, wherein each of the rib parts extends along an axial direction of the shaft part.

6. The compressor according to claim 1, wherein an outer diameter of the rib part is greater than or equal to an inner diameter of the oil recovery passage.

7. The compressor according to claim 6, wherein an outer diameter of the spiral part is greater than or equal to the outer diameter of the rib part.

8. The compressor according to claim 1, wherein the compression unit comprises:

a fixed scroll stationarily installed in the casing; and a turning scroll provided to form a compression chamber along with the fixed scroll, wherein a first passage hole that is a part of the oil recovery passage is formed in the fixed scroll, wherein a plating layer is formed on an inner circumferential surface of the first passage hole, and wherein the reducer is inserted into the first passage hole provided with the plating layer.

9. The compressor according to claim 1, wherein the shaft part, the spiral part, and the rib part are integrally formed with each other.

10. The compressor according to claim 1, wherein the shaft part and the spiral part are integrally formed with each other, and wherein the rib part is removably provided on the shaft part and the spiral part.

* * * * *